US007818168B1

(12) United States Patent
Cusmariu

(10) Patent No.: US 7,818,168 B1
(45) Date of Patent: Oct. 19, 2010

(54) METHOD OF MEASURING DEGREE OF ENHANCEMENT TO VOICE SIGNAL

(75) Inventor: Adolf Cusmariu, Eldersburg, MD (US)

(73) Assignee: The United States of America as represented by the Director, National Security Agency, Washington, DC (US)

( * ) Notice: Subject to any disclaimer, the term of this patent is extended or adjusted under 35 U.S.C. 154(b) by 991 days.

(21) Appl. No.: 11/645,264

(22) Filed: Dec. 1, 2006

(51) Int. Cl.
*G10L 19/06* (2006.01)

(52) U.S. Cl. ..... 704/209; 704/208; 704/E21.002; 704/220; 704/225; 381/71.14

(58) Field of Classification Search ..... 704/208, 704/209, E21.002, 220, 225; 381/71.14
See application file for complete search history.

(56) References Cited

U.S. PATENT DOCUMENTS

| | | | | |
|---|---|---|---|---|
| 4,827,516 | A * | 5/1989 | Tsukahara et al. | 704/224 |
| 5,251,263 | A * | 10/1993 | Andrea et al. | 381/71.6 |
| 5,742,927 | A * | 4/1998 | Crozier et al. | 704/226 |
| 5,745,384 | A * | 4/1998 | Lanzerotti et al. | 702/191 |
| 5,963,907 | A * | 10/1999 | Matsumoto | 704/270 |
| 6,510,408 | B1 * | 1/2003 | Hermansen | 704/233 |
| 6,618,699 | B1 * | 9/2003 | Lee et al. | 704/209 |
| 6,704,711 | B2 * | 3/2004 | Gustafsson et al. | 704/258 |
| 7,102,072 | B2 * | 9/2006 | Kitayama | 84/616 |
| 2001/0014855 | A1 | 8/2001 | Hardy | |
| 2002/0167937 | A1 | 11/2002 | Goodman | |
| 2004/0059572 | A1 | 3/2004 | Ivanic et al. | |
| 2004/0167774 | A1 | 8/2004 | Shrivastav | |
| 2004/0186716 | A1 | 9/2004 | Morfitt, III et al. | |
| 2007/0047742 | A1 * | 3/2007 | Taenzer et al. | 381/92 |
| 2009/0018825 | A1 * | 1/2009 | Bruhn et al. | 704/222 |
| 2009/0063158 | A1 * | 3/2009 | Norden et al. | 704/500 |

OTHER PUBLICATIONS

Purcell et al. "Compensation following real-time manipulation of formants in isolated vowels" Apr. 2006.*

Rohdenburg et al. "Objective Perceptual Quality Measures for the Evaluation of Noise Reduction Schemes" 2005.*

Yan et al. "Formant-Tracking Linear Prediction Models for Speech Processing in Noisy Enviroments" 2005.*

Cohen et al. "Speech enhancement for non-stationarynoise environments" 2001.*

Gray et al. "A Spectral-Flatness Measure for Studying the Autocorrelation Method of Linear Prediction of Speech Analysis" 1974.*

Narendranath et al. "Transformation of formants for voice conversion using artificial neural networks" 1995.*

(Continued)

*Primary Examiner*—Talivaldis Ivars Smits
*Assistant Examiner*—Greg A Borsetti
(74) *Attorney, Agent, or Firm*—Robert D. Morelli

(57) ABSTRACT

A method of measuring the degree of enhancement made to a voice signal by receiving the voice signal, identifying formant regions in the voice signal, computing stationarity for each identified formant region, enhancing the voice signal, identifying formant regions in the enhanced voice signal that correspond to those identified in the received voice signal, computing stationarity for each formant region identified in the enhanced voice signal, comparing corresponding stationarity results for the received and enhanced voice signals, and calculating at least one user-definable statistic of the comparison results as the degree of enhancement made to the received voice signal.

18 Claims, 1 Drawing Sheet

OTHER PUBLICATIONS

Martin et al. "A Noise Reduction Preprocessor for Mobile Voice Communication" 2004.*

Yan et al. "A Formant Tracking LP Model for Speech Processing in Car/Train Noise" 2004.*

Baer et al. "Spectral contrast enhancement of speech in noise for listeners with sensorineural hearing impairment: effects on intelligibility, quality, and response times" 1993.*

Lee et al. "Formant Tracking Using Segmental Phonemic Information" 1999.*

* cited by examiner

METHOD OF MEASURING DEGREE OF ENHANCEMENT TO VOICE SIGNAL

FIELD OF INVENTION

The present invention relates, in general, to data processing and, in particular, to speech signal processing.

BACKGROUND OF THE INVENTION

Methods of voice enhancement strive to either reduce listener fatigue by minimizing the effects of noise or increasing the intelligibility of the recorded voice signal. However, quantification of voice enhancement has been a difficult and often subjective task. The final arbiter has been human, and various listening tests have been devised to capture the relative merits of enhanced voice signals. Therefore, there is a need for a method of quantifying an enhancement made to a voice signal. The present invention is such a method.

U.S. Pat. Appl. No. 20010014855, entitled "METHOD AND SYSTEM FOR MEASUREMENT OF SPEECH DISTORTION FROM SAMPLES OF TELEPHONIC VOICE SIGNALS," discloses a device for and method of measuring speech distortion in a telephone voice signal by calculating and analyzing first and second discrete derivatives in the voice waveform that would not have been made by human articulation, looking at the distribution of the signals and the number of times the signals crossed a predetermined threshold, and determining the number of times the first derivative data is less than a predetermined value. The present invention does not measure speech distortion as does U.S. Pat. Appl. No. 20010014855. U.S. Pat. Appl. No. 20010014855 is hereby incorporated by reference into the specification of the present invention.

U.S. Pat. Appl. No. 20020167937, entitled "EMBEDDING SAMPLE VOICE FILES IN VOICE OVER IP (VoIP) GATEWAYS FOR VOICE QUALITY MEASUREMENTS," discloses a method of measuring voice quality by using the Perceptual Analysis Measurement System (PAMS) and the Perceptual Speech Quality Measurement (PSQM). The present invention does not use PAMS or PSQM as does U.S. Pat. Appl. No. 20020167937. U.S. Pat. Appl. No. 20020167937 is hereby incorporated by reference into the specification of the present invention.

U.S. Pat. Appl. No. 20040059572, entitled "APPARATUS AND METHOD FOR QUANTITATIVE MEASUREMENT OF VOICE QUALITY IN PACKET NETWORK ENVIRONMENTS," discloses a device for and method of measuring voice quality by introducing noise into the voice signal, performing speech recognition on the signal containing noise. More noise is added to the signal until the signal is no longer recognized. The point at which the signal is no longer recognized is a measure of the suitability of the transmission channel. The present invention does not introduce noise into a voice signal as does U.S. Pat. Appl. No. 20040059572. U.S. Pat. Appl. No. 20040059572 is hereby incorporated by reference into the specification of the present invention.

U.S. Pat. Appl. No. 20040167774, entitled "AUDIO-BASED METHOD SYSTEM, AND APPARATUS FOR MEASUREMENT OF VOICE QUALITY," discloses a device for and method of measuring voice quality by processing a voice signal using an auditory model to calculate voice characteristics such as roughness, hoarseness, strain, changes in pitch, and changes in loudness. The present invention does not measure voice quality as does U.S. Pat. Appl. No. 20040167774. U.S. Pat. Appl. No. 20040167774 is hereby incorporated by reference into the specification of the present invention.

U.S. Pat. Appl. No. 20040186716, entitled "MAPPING OBJECTIVE VOICE QUALITY METRICS TO A MOS DOMAIN FOR FIELD MEASUREMENTS," discloses a device for and method of measuring voice quality by using the Perceptual Evaluation of Speech Quality (PESQ) method. The present invention does not use the PESQ method as does U.S. Pat. Appl. No. 20040186716. U.S. Pat. Appl. No. 20040186716 is hereby incorporated by reference into the specification of the present invention.

U.S. Pat. Appl. No. 20060093094, entitled "AUTOMATIC MEASUREMENT AND ANNOUNCEMENT VOICE QUALITY TESTING SYSTEM," discloses a device for and method of measuring voice quality by using the PESQ method, the Mean Opinion Score (MOS-LQO) method, and the R-Factor method described in International Telecommunications Union (ITU) Recommendation G.107. The present invention does not use the PESQ method, the MOS-LQO method, or the R-factor method as does U.S. Pat. Appl. No. 20060093094. U.S. Pat. Appl. No. 20060093094 is hereby incorporated by reference into the specification of the present invention.

SUMMARY OF THE INVENTION

It is an object of the present invention to measure the degree of enhancement made to a voice signal.

The present invention is a method of measuring the degree of enhancement made to a voice signal.

The first step of the method is receiving the voice signal.

The second step of the method is identifying formant regions in the voice signal.

The third step of the method is computing stationarity for each formant region identified in the voice signal.

The fourth step of the method is enhancing the voice signal.

The fifth step of the method is identifying the same formant regions in the enhanced voice signal as was identified in the second step.

The sixth step of the method is computing stationarity for each formant region identified in the enhanced voice signal.

The seventh step of the method is comparing corresponding results of the third and sixth steps.

The eighth step of the method is calculating at least one user-definable statistic of the results of the seventh step as the degree of enhancement made to the voice signal.

DETAILED DESCRIPTION

Figure 1:
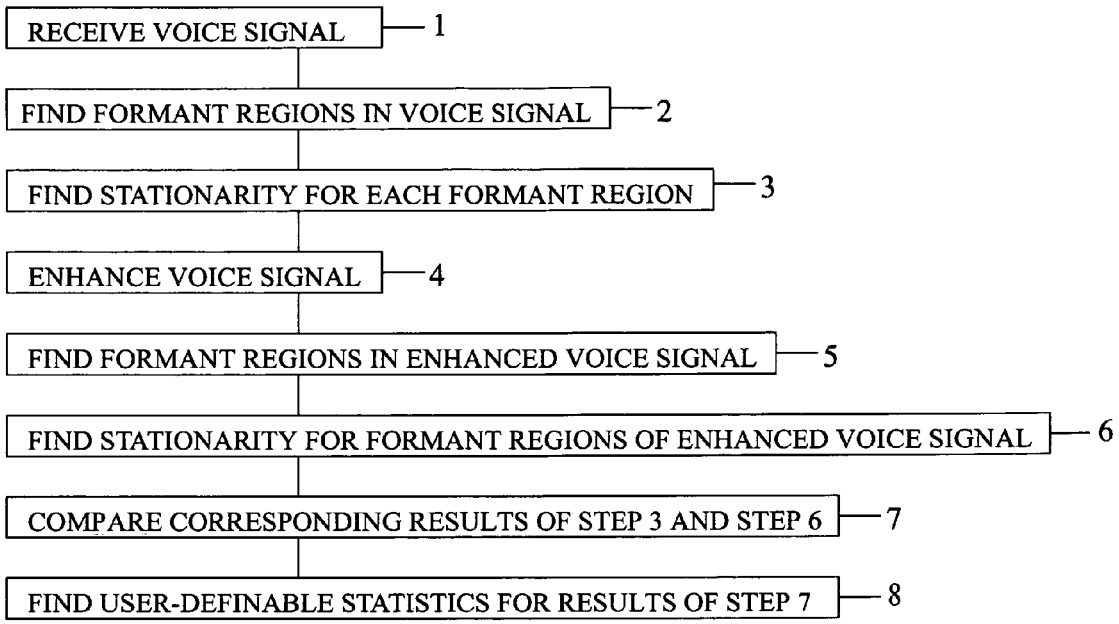
FIG. 1 is a flowchart of the present invention.

The present invention is a method of measuring the degree of enhancement made to a voice signal. Voice signals are statistically non-stationary. That is, the distribution of values in a signal changes with time. The more noise, or other corruption, that is introduced into a signal the more stationary its distribution of values becomes. In the present invention, the degree of reduction in stationarity in a signal as a result of a modification to the signal is indicative of the degree of enhancement made to the signal.

FIG. 1 is a flowchart of the present invention.

The first step 1 of the method is receiving a voice signal. If the voice signal is received in analog format, it is digitized in order to realize the advantages of digital signal processing (e.g., higher performance). In an alternate embodiment, the voice signal is segmented into a user-definable number of segments.

The second step 2 of the method is identifying a user-definable number of formant regions in the voice signal. A formant is any of several frequency regions of relatively great intensity and variation in the speech spectrum, which together determine the linguistic content and characteristic quality of the speaker's voice. A formant is an odd multiple of the fundamental frequency of the vocal tract of the speaker. For the average adult, the fundamental frequency is 500 Hz. The first formant region centers around the fundamental frequency. The second format centers around 1500 Hz. The third formant region centers around 2500 Hz. Additional formants exist at higher frequencies. Any number of formant regions derived by any sufficient method may be used in the present invention. In the preferred embodiment, the Cepstrum (pronounced kept-strum) is used to identify formant regions. Cepstrum is a jumble of the word "spectrum." It was arrived at by reversing the first four letters of the word "spectrum." A Cepstrum may be real or complex. A real Cepstrum of a signal is determined by computing a Fourier Transform of the signal, determining the absolute value of the Fourier Transform, determining the logarithm of the absolute value, and computing the Inverse Fourier Transform of the logarithm. A complex Cepstrum of a signal is determined by computing a Fourier Transform of the signal, determining the complex logarithm of the Fourier Transform, and computing the Inverse Fourier Transform of the logarithm. Either a real Cepstrum or an absolute value of a complex Cepstrum may be used in the present invention.

The third step 3 of the method is computing stationarity for each formant region identified in the voice signal. Stationarity refers to the temporal change in the distribution of values in a signal. A signal is deemed stationary if its distribution of values does not change within a user-definable period of time. In the preferred embodiment, stationarity is determined using at least one user-definable average of values in the user-definable formant regions (e.g., arithmetic average, geometric average, and harmonic average, etc.). The arithmetic average of a set of values is the sum of all values divided by the total number of values. The geometric average of a set of n values is found by calculating the product of the n values, and then calculating the nth-root of the product. The harmonic average of a set of values is found by determining the reciprocals of the values, determining the arithmetic average of the reciprocals, and then determining the reciprocal of the arithmetic average. The arithmetic average of a set of positive values is larger than the geometric average of the same values, and the geometric average of a set of positive values is larger than the harmonic average of the same values. The closer, or less different, these averages are to each other the more stationary is the corresponding voice signal. Any combination of these averages may be used in the present invention to gauge stationarity of a voice signal (i.e., arithmetic-geometric, arithmetic-harmonic, and geometric-harmonic). Any suitable difference calculation may be used in the present invention. In the preferred embodiment, difference calculations include difference, ratio, difference divided by sum, and difference divided by one plus the difference.

The fourth step 4 of the method is enhancing the voice signal received in the second step 2. In an alternate embodiment, a digitized voice signal and/or segmented voice signal is enhanced. Any suitable enhancement method may be used in the present invention (e.g., noise reduction, echo cancellation, delay-time minimization, volume control, etc.).

The fifth step 5 of the method is identifying formant regions in the enhanced voice signal that correspond to those identified in the second step 2.

The sixth step 6 of the method is computing stationarity for each formant region identified in the enhanced voice signal.

The seventh step 7 of the method is comparing corresponding results of the third step 3 and the sixth step 6. Any suitable comparison method may be used in the present invention. In the preferred embodiment, the comparison method is chosen from the group of comparison methods that include ratio minus one and difference divided by sum.

The eighth step 8 of the method is calculating at least one user-definable statistic of the results of the seventh step 7 as the degree of enhancement made to the voice signal. Any suitable statistical method may be used in the present invention. In the preferred embodiment, the statistical method is chosen from the group of statistical methods including arithmetic average, median, and maximum value.

What is claimed is:

1. A method of measuring the degree of enhancement made to a voice signal, comprising the steps of:

a) receiving, on a digital signal processor, the voice signal;

b) identifying, on the digital signal processor, a user-definable number of formant regions in the voice signal;

c) computing, on the digital signal processor, stationarity for each formant region identified in the voice signal;

d) enhancing, on the digital signal processor, the voice signal;

e) identifying, on the digital signal processor, formant regions in the enhanced voice signal that correspond to those identified in step (b);

f) computing, on the digital signal processor, stationarity for each formant region identified in the enhanced voice signal;

g) comparing, on the digital signal processor, corresponding results of step (c) and step (f); and h) calculating, on the digital signal processor, at least one user-definable statistic of the results of step (g) as the degree of enhancement made to the voice signal.

2. The method of claim 1, further including the step of digitizing the received voice signal if the signal is received in analog format.

3. The method of claim 1, further including the step of segmenting the received voice signal into a user-definable number of segments.

4. The method of claim 1, wherein each step of identifying formant regions is comprised of the step of identifying formant regions using an estimate of a Cepstrum.

5. The method of claim 4, wherein the step of estimating a Cepstrum is comprised of selecting from the group of Cepstrum estimations consisting of a real Cepstrum and an absolute value of a complex Cepstrum.

6. The method of claim 1, wherein each step of computing stationarity for each formant region is comprised of the steps of:

i) calculating an arithmetic average of the formant region;

ii) calculating a geometric average of the formant region;

iii) calculating a harmonic average of the formant region; and iv) comparing any user-definable combination of two results of step (i), step (ii), and step (iii).

7. The method of claim 6, wherein the step of comparing any user-definable combination of two results of step (i), step (ii), and step (iii) is comprised of the step of comparing any user-definable combination of two results of step (i), step (ii), and step (iii) using a comparison method selected from the group of comparison methods consisting of difference, difference divided by sum, and difference divided by one plus the difference.

8. The method of claim 1, wherein each step of enhancing the voice signal is comprised of enhancing the voice signal using a voice enhancement method selected from the group of voice enhancement methods consisting of, echo cancellation, delay-time minimization, and volume control.

9. The method of claim 1, wherein the step of comparing corresponding results of step (c) and step (f) is comprised of comparing corresponding results of step (c) and step (f) using a comparison method selected from the group of comparison methods consisting of a ratio of corresponding results of step (c) and step (f) minus one and a difference of corresponding results of step (c) and step (f) divided by a sum of corresponding results of step (c) and step (f).

10. The method of claim 1, wherein the step of calculating at least one user-definable statistic of the results of step (g) is comprised of calculating at least one user-definable statistic of the results of step (g) using a statistical method selected from the group of statistical methods consisting of arithmetic average, median, and maximum value.

11. The method of claim 2, further including the step of segmenting the received voice signal into a user-definable number of segments.

12. The method of claim 11, wherein each step of identifying formant regions is comprised of the step of identifying formant regions using an estimate of a Cepstrum.

13. The method of claim 12, wherein the step of estimating a Cepstrum is comprised of selecting from the group of Cepstrum estimations consisting of a real Cepstrum and an absolute value of a complex Cepstrum.

14. The method of claim 13, wherein each step of computing stationarity for each formant region is comprised of the steps of:

i) calculating an arithmetic average of the formant region;

ii) calculating a geometric average of the formant region;

iii) calculating a harmonic average of the formant region; and iv) comparing any user-definable combination of two results of step (i), step (ii), and step (iii).

15. The method of claim 14, wherein the step of comparing any user-definable combination of two results of step (i), step (ii), and step (iii) is comprised of the step of comparing any user-definable combination of two results of step (i), step (ii), and step (iii) using a comparison method selected from the group of comparison methods consisting of difference, ratio, difference divided by stun, and difference divided by one plus the difference.

16. The method of claim 15, wherein each step of enhancing the voice signal is comprised of enhancing the voice signal using a voice enhancement method selected from the group of voice enhancement methods consisting of echo cancellation, delay-time minimization, and volume control.

17. The method of claim 16, wherein the step of comparing corresponding results of step (c) and step (f) is comprised of comparing corresponding results of step (c) and step (f) using a comparison method selected from the group of comparison methods consisting of a ratio of corresponding results of step (c) and step (f) minus one and a difference of corresponding results of step (c) and step (f) divided by a sum of corresponding results of step (c) and step (f).

18. The method of claim 17, wherein the step of calculating at least one user-definable statistic of the results of step (g) is comprised of calculating at least one user-definable statistic of the results of step (g) using a statistical method selected from the group of statistical methods consisting of arithmetic average, median, and maximum value.

* * * * *